US012752942B2

(12) United States Patent
Monroy Oropeza et al.

(10) Patent No.: US 12,752,942 B2
(45) Date of Patent: Oct. 6, 2026

(54) APPARATUS FOR PRODUCTS PACKAGING

(71) Applicant: Heat and Control, Inc., Hayward, CA (US)

(72) Inventors: Jhonatan Monroy Oropeza, Guadalajara (MX); Andrew Anthony Caridis, San Carlos, CA (US); Leopoldo Zarate Andrade, Tlajomulco de Zuniga (MX)

(73) Assignee: Heat and Control, Inc., Hayward, CA (US)

( * ) Notice: Subject to any disclaimer, the term of this patent is extended or adjusted under 35 U.S.C. 154(b) by 0 days.

(21) Appl. No.: 18/517,357

(22) Filed: Nov. 22, 2023

(65) Prior Publication Data

US 2024/0083607 A1 Mar. 14, 2024

Related U.S. Application Data

(63) Continuation-in-part of application No. PCT/IB2022/054765, filed on May 20, 2022.

(30) Foreign Application Priority Data

May 27, 2021 (MX) ..... MX/A/2021/006240

(51) Int. Cl.
*B65B 11/00* (2006.01)
*B65B 1/06* (2006.01)
(Continued)

(52) U.S. Cl.
CPC ..... *B65B 1/06* (2013.01); *B65B 35/02* (2013.01); *B65B 35/32* (2013.01); *B65B 35/44* (2013.01); *B65B 43/36* (2013.01); *B65B 43/46* (2013.01)

(58) Field of Classification Search
CPC ..... B65G 17/46; B65G 17/32; B65G 47/248; B65G 2201/0202; B65B 5/10;
(Continued)

(56) References Cited

U.S. PATENT DOCUMENTS 1,425,481 A 8/1922 Howard
1,934,756 A 11/1933 Smith
(Continued)

FOREIGN PATENT DOCUMENTS

GB 2426498 A 11/2006
JP 59-43306 U 3/1984
(Continued)

OTHER PUBLICATIONS

International Search Report dated Sep. 6, 2022 for Application No. PCT/IB2022/054765, filed May 20, 2022, pp. 1-5.
(Continued)

*Primary Examiner* — Andrew M Tecco
(74) *Attorney, Agent, or Firm* — Law Offices of Donald N. MacIntosh

(57) ABSTRACT

An apparatus comprising a conveyor with a conveyor belt and a series of stacking towers spaced along the length of the conveyor belt and secured to the conveyor belt. Each of the stacking towers has a chamber adapted for receiving fragile goods. A drive gear is coupled to the conveyor belt for advancing the stacking tower with goods in the chamber to a baler, which is configured to place a mouth of one of the plurality of empty packages over the stacking tower with goods in the chamber. The conveyor is configured so that further advancement of the conveyor belt by the drive gear causes the stacking tower to tilt so that the goods slide into the package and the package slides off the stacking tower, in each case under the force of gravity. Method for packaging fragile goods using stacking towers is provided.

15 Claims, 10 Drawing Sheets

(51) Int. Cl.

| | |
|---|---|
| ***B65B 35/02*** | (2006.01) |
| ***B65B 35/32*** | (2006.01) |
| ***B65B 35/44*** | (2006.01) |
| ***B65B 43/36*** | (2006.01) |
| ***B65B 43/46*** | (2006.01) |

(58) Field of Classification Search
CPC ..... B65B 11/54; B65B 35/32; B65B 1/06; B65B 25/16; B65B 35/56; B65B 5/067; B26D 7/0625; B26D 7/32
See application file for complete search history.

(56) References Cited

U.S. PATENT DOCUMENTS

| | | | | |
|---|---|---|---|---|
| 2,101,870 | A | 12/1937 | Pattison, Jr. | |
| 2,679,963 | A * | 6/1954 | Neal | B65B 21/22 53/499 |
| 3,941,237 | A * | 3/1976 | MacGregor, Jr. | B65G 17/32 211/74 |
| 5,794,410 | A | 8/1998 | Harper | |
| 6,508,588 | B1 * | 1/2003 | Meyer | B65D 33/001 206/554 |
| 9,139,314 | B2 * | 9/2015 | Ishikawa | B65B 43/16 |
| 9,352,867 | B2 * | 5/2016 | Actis | B65B 39/02 |
| 11,019,826 | B2 * | 6/2021 | Scherz | B65B 35/44 |
| 2002/0112452 | A1 * | 8/2002 | DeSmedt | B65D 33/001 53/571 |
| 2019/0216097 | A1 * | 7/2019 | Scherz | B26D 7/0625 |

FOREIGN PATENT DOCUMENTS

| | | | |
|---|---|---|---|
| JP | 2013-82480 A | | 5/2013 |
| JP | 2013082480 A | * | 5/2013 |
| MX | 287801 B | | 6/2011 |

OTHER PUBLICATIONS

Office Action dated Jan. 25, 2024 for Canadian Application No. 3,173,086, filed May 20, 2022, pp. 1-3.
Written Opinion dated Sep. 6, 2022 for Application No. PCT/IB2022/054765, filed May 20, 2022, pp. 1-4.
Office Action dated Sep. 18, 2024 for Mexican Application No. MX/a/2021/006240, filed May 27, 2021, pp. 1-5.
Translation of Office Action dated Sep. 18, 2024 for Mexican Application No. MX/a/2021/006240, filed May 27, 2021, pp. 1-6.
Response dated May 24, 2024 to Office Action dated Jan. 25, 2024 for Canadian Application No. 3,173,086, filed May 20, 2022, pp. 1-18.
Response dated Jan. 23, 2025 to Office Action dated Sep. 18, 2024 for Mexican Application No. MX/a/2021/006240, filed May 27, 2021 (with English-language translation).
Office Action dated Sep. 11, 2025 for Japanese Application No. 2023-573234, filed May 20, 2022 ( with English-language translation).
Office Action dated Feb. 18, 2026 for Chilean Application No. 202303504, filed May 20, 2022 (with English-language translation).
Response dated Mar. 11, 2026 to Office Action dated Sep. 11, 2025 for Japanese Application No. 2023-573234, filed May 20, 2022 (with English-language translation).

* cited by examiner

APPARATUS FOR PRODUCTS PACKAGING

CROSS REFERENCE TO RELATED APPLICATION

This application claims priority to International Application Number PCT/IB2022/054765 filed May 20, 2022, which claims priority to MX/a/2021/006240 filed May 27, 2021, the entire contents of each of which are incorporated herein by this reference.

FIELD OF THE INVENTION

The present invention generally relates to packaging products, and particularly to packaging food products.

BACKGROUND OF THE INVENTION

Fragile foodstuffs, for example corn tostadas, require care in their handling. In areas such as Mexico, such food products are sometimes transported by wicker baskets lined for shock dampening purposes with white cloth cotton napkins. In more industrialized processes, handling and transportation are accomplished by hand bailing the goods, for example by a conveyor belt that carries the food products to a plurality of packing stations where the goods are baled, bagged or packaged by hand. Such a packing process is highly tedious and tiring. In addition, such process is labor intensive, which increases production costs.

Automated packaging systems have been provided. See, for example, U.S. Pat. No. 1,934,756, MX 287809 by Yan Ruz et al., U.S. Pat. No. 5,794,410 by Robert Harper and GB 2426498B by Bate et al.

Notwithstanding, the different packaging alternatives which are known in the field, the need exists for additional packing solutions for fragile brittle goods that improves handling of the goods, eases the transportation process and delivers the goods to the user unbroken, therefore reducing costs and waste.

BRIEF DESCRIPTION OF THE FIGURES

The drawings described herein are for illustration purposes only and are not intended to limit the scope of the present disclosure in any way.

DETAILED DESCRIPTION

Figure 1:
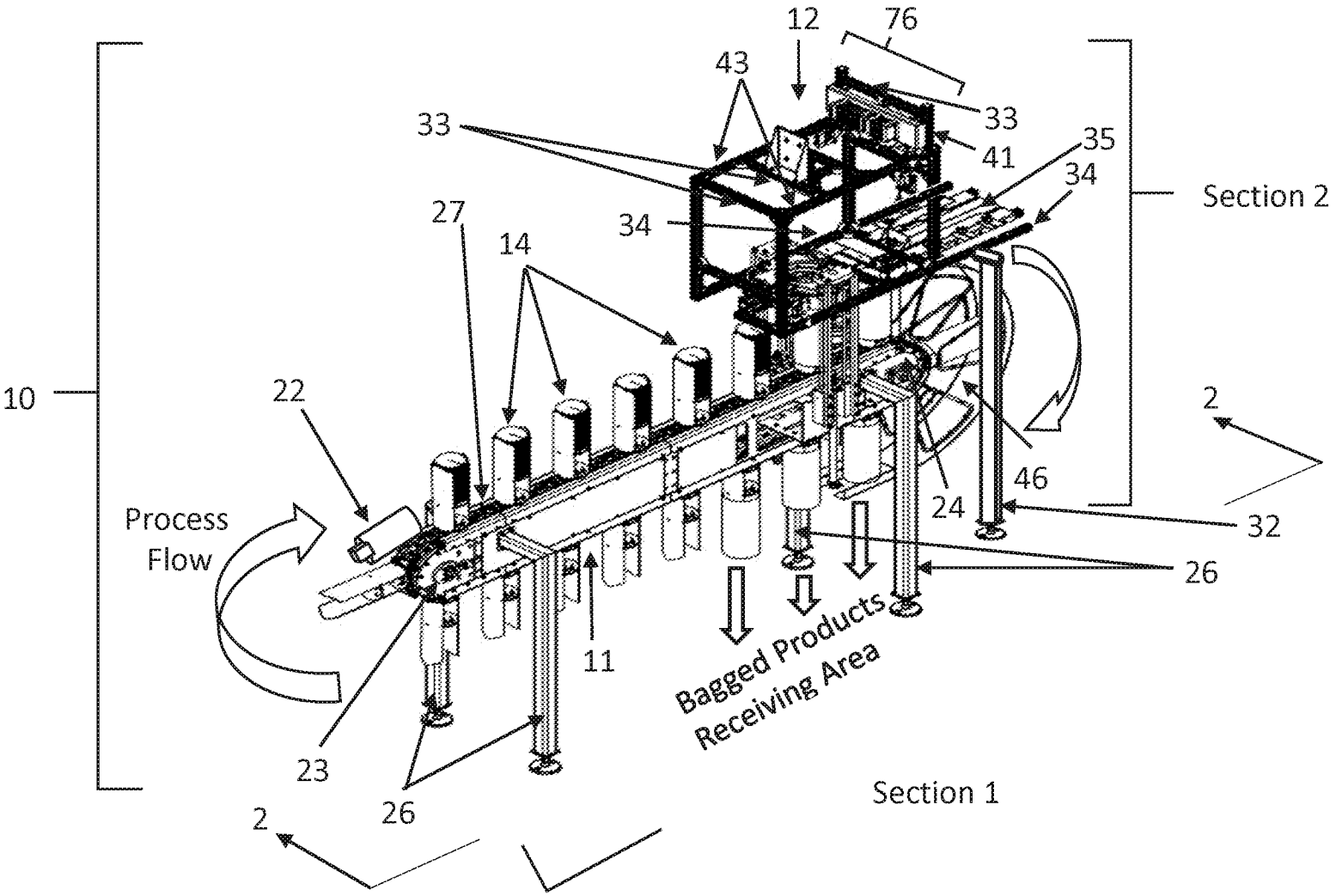
FIG. 1 is an isometric view of an embodiment of an apparatus for packaging products of the invention; where one pair of struts have been removed for clarity purposes.

The industrial method and apparatus of the invention pertain to packaging goods or products of any type, including fragile goods or products, food products or any combination of the foregoing. The goods or products can optionally include brittle goods or fragile goods, for example brittle or fragile food products or goods. The goods or products can be of any shape, for example have a plate, round, oval, spherical, cylindrical or discoidal shape, or any combination of the foregoing. The goods for products can be made from various materials. The goods or products can have various mechanical features, for example fragility, brittleness or hardness, that may complicate their handling and subsequent transportation. The food products can optionally include tostadas, tortillas, fruits, vegetables or bread. The goods or products can optionally nonfood related products, for example compact discs, steel or cutting discs, cylinders such as thermoses, Christmas balls, a variety of balls, golf balls, tennis balls, baseball balls, hockey pucks, glasses, cups or cylindrical containers.

The method and apparatus of the invention can include an industrial process that involves placing one or more goods in a stacking tower, which can optionally be referred to as a container. The stacking tower has a chamber for receiving the goods. The stacking tower can optionally be partially or entirely filled with goods. An empty package, bag or cover is placed by the method and apparatus of the invention over the stacking tower having the goods therein. The package can be referred to as covering, veiling or shrouding at least the opening of the stacking tower or along a portion of or the entire length of the stacking tower. The stacking tower can be tilted by the method and apparatus of the invention, for example to an angle inclined downwardly or upside down, so that the goods in the stacking tower empty into the package, for example partially or entirely under the force of gravity. The tilting of the stacking tower can optionally cause the package to slide off the stacking tower, for example partially or entirely under the force of gravity.

A series or a plurality of stacking towers can be provided, for example spaced apart along a length of a conveyor belt of the apparatus of the invention and secured, coupled or mounted to the conveyor belt. The stacking towers can optionally be fixed or pivotably coupled to the conveyor belt. The towers can optionally be mounted vertically, for example at a right angle to the conveyor belt, or inclined at an angle less than 90° to the conveyor belt. The conveyor belt can optionally be part of a conveyor system, which can be configured so that advancement of the conveyor belt causes the stacking tower when containing goods to tilt and the goods in the stacking tower to slide or empty into the package, for example partially or entirely under the force of gravity. The conveyor system can optionally be configured so that tilting of the stacking tower causes the package to slide off the stacking tower, for example partially or entirely under the force of gravity. The conveyor system can optionally be provided with a gear and configured so that advancement of the conveyor belt around the gear causes such tilting of the stacking tower.

The empty package can be made from any suitable material, for example polyethylene, polypropylene, cellophane, paper, a thermoplastic combination with natural fibers, recycled materials, biodegradable compounds or any combination of the foregoing. The empty package can be placed over the stacking tower by the industrial method and apparatus of the invention in any suitable manner. For example, the mouth of an empty package can be placed over the stacking tower, for example the top of the stacking tower having an opening therein for receiving the goods. The empty package can be slid down the exterior of the stacking tower, for example to cover some or all of the length of the stacking tower. The empty package can optionally have a shape that approximates or conforms to the shape of the stacking tower. The empty package can optionally have a length less than the length of the stacking tower or approximating the length of the stacking tower. The empty package can optionally be placed over the stacking tower having goods therein to cover the goods in the stacking tower with the package.

The industrial process and apparatus of the invention can optionally include selecting an empty package from a plurality of stored empty packages. A suitable package picking mechanism can be provided for this purpose. Industrial process and apparatus can optionally include opening the mouth of the empty package to permit placement of the empty package over the stacking tower. Such opening step can optionally include blowing air through the mouth of the package to expand the package. A suitable package opening mechanism can be provided For the foregoing.

The apparatus for packaging goods of the invention can optionally include first and second sections. The first section can optionally include a conveyor system with stacking towers mounted on a conveyor which transports goods of any suitable type, for example fragile brittle products with a given shape, to a baling, bagging or packaging area. The second section can optionally include a baler, to which covers, bags or packages are supplied. The covers, bags or packages can optionally be taken from a stack by any suitable means, for example by one or more suction cups, which can optionally place them on a shutter by means of tweezers. The tweezers can optionally grab the covers, bags or packages on their lower part. Once in this position, another set of one or more suction cups can optionally open the covers, bags or packages. The shutter opens the cover, bag or package and fastens it by the mouth to later descend over a stacking tower so as to shroud, cover or veil the tower with the cover, bag or package. The covered stacking tower continue along the conveyor system until tilted by the conveyor to a downwardly inclined angle, for example an upside down position, which causes separation of the goods from within the shrouded stacking tower, for example under the force of gravity. Once separated from the stacking tower, goods are collected within the covers, bags or packages containing, which are then optionally closed. The closing of the covers, bags or packages can be done manually or automatically, for example in a process that is independent from the baling or packaging of the process and apparatus of the present invention.

The accompanying figures are illustrative of an embodiment of the process and apparatus of the invention. It is appreciated that other embodiments of the process and apparatus of the invention can be provided.

When referring to any structural feature, mechanical link or component of the apparatus of the invention, the terms mechanically or otherwise fixed, joined, secured or fastened includes any means known in the art for such purpose, for example screws, nuts, rivets, any kind of welding, agglutinant, clamps, mechanical joints (dynamic or static), or any combination of the foregoing.

An embodiment of an apparatus for packaging products 10 of the present invention is illustrated in FIG. 1. The first section of apparatus 10 includes conveyor system or assembly 11 with stacking towers 14 mounted in spaced apart longitudinal position along the conveyor belt 27 of the conveyor system. The second section of apparatus 10 can optionally be formed by the structure of the baler 12, which supports the shrouding mechanisms that cover, veil or shroud the goods filled or containing stacking towers 14.

Figure 7A:
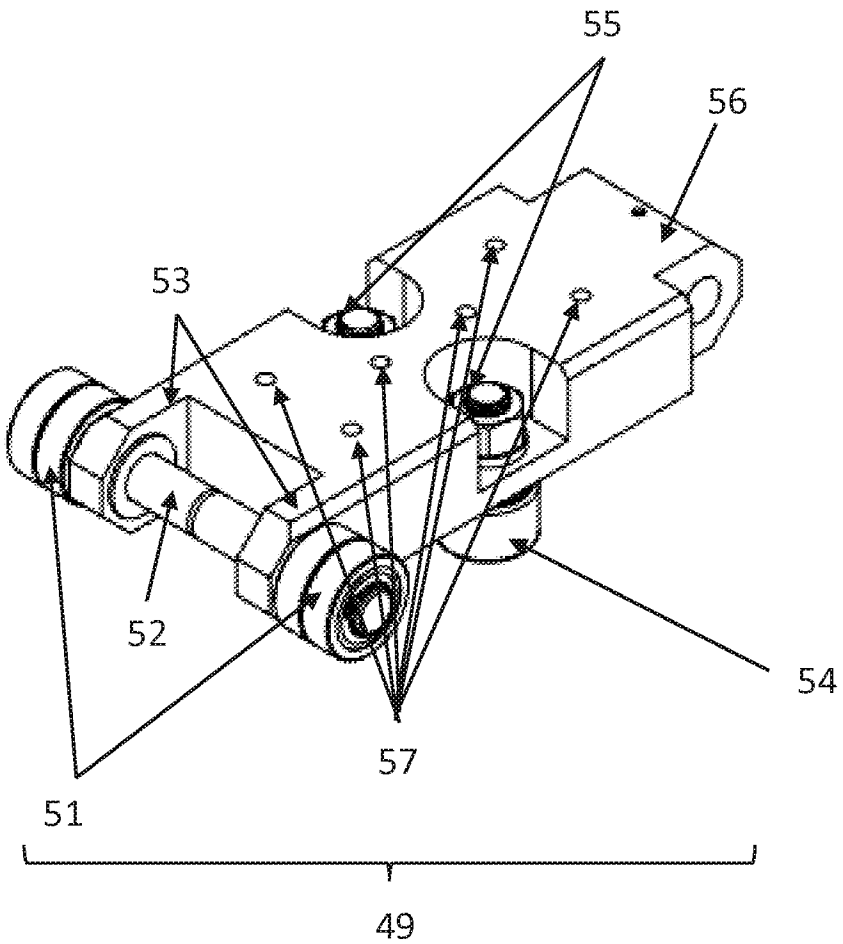
FIG. 7A is an inferior isometric view of an embodiment of a link of the conveyor of the apparatus of FIG. 1.
Figure 7B:
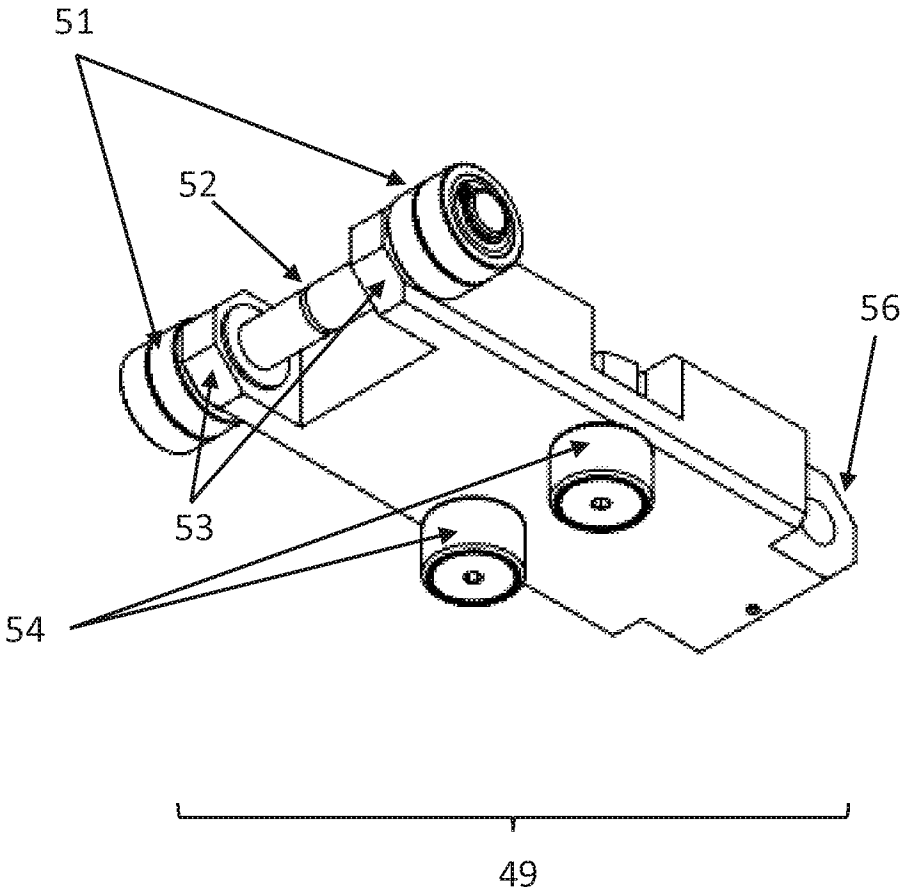
FIG. 7B is an upper isometric view of the link of FIG. 7A.

Conveyor system or conveyor 11 optionally includes highly precise placement or indexing equipment, for example optionally including a high precision endless chain indexing conveyor belt 27. The high precision indexing conveyor system 11 can be of any suitable type. One suitable conveyor system 11 includes a series of links 49 fixedly joined in a chain manner to form a conveyor belt 27. The upper part of each link 49 can optionally include a platform with a series of threaded holes 57 to which a series of stacking towers 14 can be fastened in spaced apart position along the length of the conveyor belt 27 (see FIG. 7A). Such fastening can be by any suitable means, for example screws or any other suitable mechanical fastening means or fastener. Conveyor belt 27 of conveyor 11 can optionally have a chain like structure, formed by a series of links 49 that are linked to each other. Links 49 can be of any suitable type, for example as shown in FIGS. 7A and 7B, and are optionally provided with a fork 53 at the rear end of the link. Each of the fork 53 arms can be provided with a hole for housing a shaft 52 with one mechanically fixed appended bearing 51 on each end of the shaft. On the opposite end of the fork 53 of the link 49, namely the front end, a nipple 56 is formed. The nipple 56 incudes a hole to house another shaft 52. The nipple 56 is shaped and dimensioned to be housed in the fork 53 of the contiguous or adjoining link 49. In this regard, the fork 53 and the nipple 56 holes are collinear and capable of hosting or rotatably carrying a shaft 52 that connects adjoining links 49 together. When a shaft is inserted in the fork 53 and the nipple 56 holes the result is a pair of contiguous links 49 that are linked together. On each of the exposed free ends of the shaft 52 an appended bearing is mechanically fixed. Such a configuration of adjoined links 49 continues until the desired length of the chained conveyor belt 27 is achieved, thereby providing an "endless" flexible closed type conveyor belt 27.

Jutting from the lower face of the link 49 is a set of bearings 54 are optionally provided. Each bearing 54 is mechanically fixed to a vertical pin 55, which is threaded on one end and cylindrical smoothened on the other end. The vertical pin 55 can be inserted in a vertical hole to be mechanically fixed on the upper part of the link 49 by any suitable means, for example a nut screwed unto the thread of the vertical pin 55 (see FIGS. 7A, 7B). The bearings 54 can optionally be placed on the remaining or opposite end of the vertical pins 55 by means of an interference adjustment, with an optional lock washer as a safety retainer device at the end of the vertical pin 55. This arrangement causes the bearings 54 to overhang or extend from the lower face of the link 49. In another embodiment, a couple of bearings 54 can be placed on a single pin 55. In another embodiment, a single bearing 54 on a single pin 55 can be set at the center of the lower face of the link 49. On the upper face of the link 49 a plurality of threaded holes 57 are optionally provided for screwing in place a stacking tower 14 to the upper face of the link 49. Ishida and Fastback type clamps or fastening means, or any other suitable mechanical fastening means, can optionally be utilized. Links 49 of the conveyor belt 27 can be made from any suitable material, for example steel, aluminum or a thermoplastic and metal combination. For example, a link 49 can optionally have a sheet plate or steel or aluminum laminate coated by a suitable thermoplastic. The links 49 can optionally be manufactured from a suitable thermoplastic that permits the links to support and mechanically grasp the respective stacking towers 14. The pins 55 and shaft 52 can be made from any suitable material, for example steel or round extruded cold rolled steel. Bearings 54 and appended bearings 51 can be made from any suitable material, for example steel ball bearings of commercial grade.

Figure 6A:
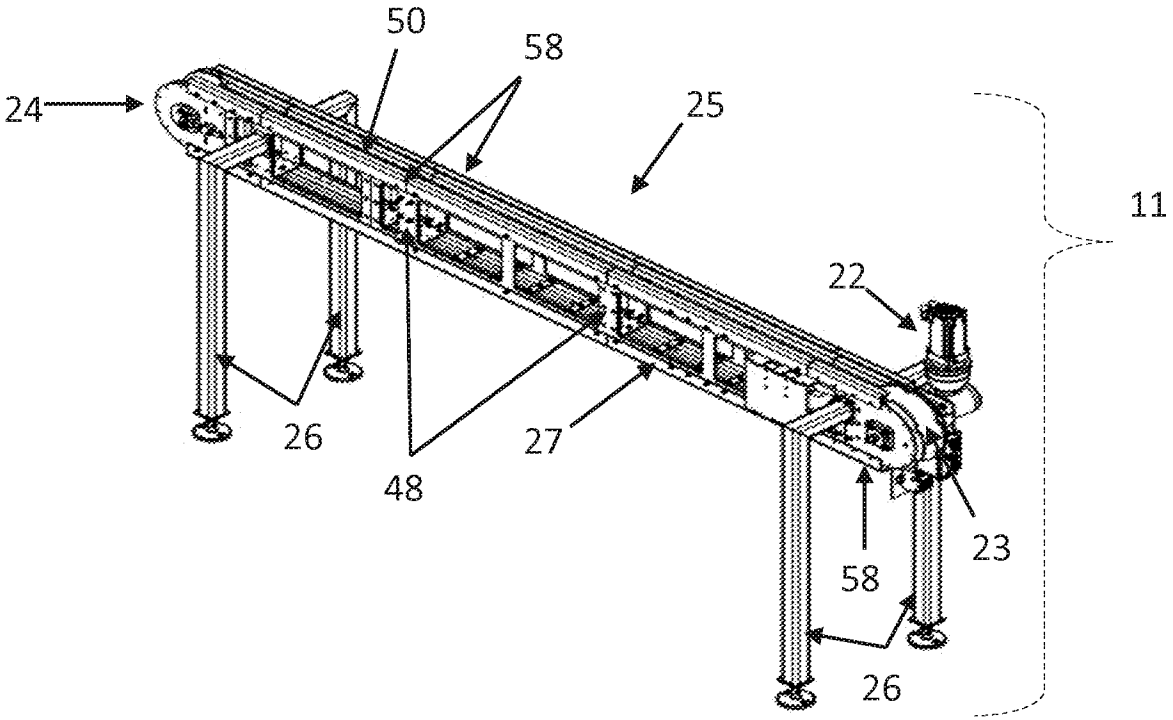
FIG. 6A is an isometric view of an embodiment of a conveyor chassis of the apparatus of FIG. 1.
Figure 6B:
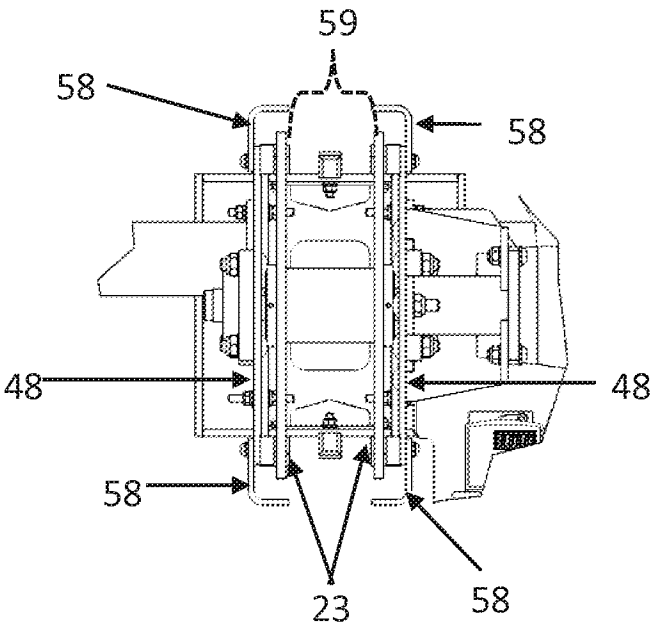
FIG. 6B is a side view of an embodiment of a conveyor of the apparatus of FIG. 1 illustrating a head of the conveyor.

Conveyor 11 can optionally include a chassis 25 constructed over a pair of crossbars 48, which can be manufactured of extruded steel, extruded aluminum or any other suitable material. In some embodiments, a rectangular shingle with constant cross section can be employed. Windows or holes can optionally be carved into or provided in the crossbars 48 to reduce weight. provide an access area for servicing or both (see FIGS. 1, 2). The crossbars 48 can optionally be made from a "C" profile extruded steel or aluminum. The upper longitudinal edge and lower longitudinal edge of each crossbar 48 provides a raceway 50, over which the bearings 51 of the links 49 roll on. A pair of guards 58 can optionally be disposed in the outer face of the longitudinal edges, for example the upper and lower edges, of the crossbars 48. The guards 58 can function as a safety device for users or operators, so a pinch point is avoided (see FIG. 6B). Optional "J" cross section shaped guards 58 are shown in FIGS. 6A and 6B. The guards 58 can be manufactured out of extruded steel of aluminum, a bent sheet of steel or aluminum, an extruded profile made from any of the foregoing materials or any combination of the foregoing. The guards 58 can be mechanically fixed to the crossbars 48 in any suitable manner, for example by means of welding. The guards 58 can optionally serve to inhibit or prevent the bearings 51 of the links 49 from departing the raceway 50 regardless of whether the links 49 are circulating over the upper longitudinal edge or the lower longitudinal edge of the crossbars 48. It is appreciated that the guards 58 can optionally have any other cross sectional shape, or be optionally eliminated. A channel 59 can optionally be constructed between the upper and lower inner faces of the crossbars 48. The pair of bearing 54 at the bottom of each link 49 are disposed within the longitudinal cavity or slot of channel 59 so as to be guided or constrained during movement by the channel 59.

The conveyor belt system 11 can optionally include a driver shaft supported by colinear bearings (not shown) placed at the proximal end of the crossbars 48, taking FIG. 6B as a reference. The drive shaft can optionally be mechanically coupled to a gear box fixed to an electric motor 22. A driven shaft is fastened within a pair of colinear bearings on the remaining or opposite distal end of the crossbars 48. The drive shaft can optionally anchor a driven crown gear 24. A plurality of links 49 form a closed type chain that goes around the crossbars 48 through the raceway 50. The appended bearings 51 of the links 49 engage with a driver crown gear 23 and the driven crown gear 24. In this way the chain of the conveyor belt 27 formed by the links 49 can move in a smooth and constant manner through or along the raceway 50 when the driver crown gear 23 receives energy from the motor 22 through the driver shaft and transmits this energy to the links 49 in the conveyor belt chain when the teeth of the driver crown 23 engages with the appended bearings 51. The foregoing causes movement of the links 49 along the raceway 50. In the same manner the appended bearings 51 of the links 49 can optionally engage with the teeth of the driven crown gear 24 in the distal end of the crossbars 48. A driven crown gear 24 can optionally be provided without any carved teeth on its periphery. For example, the driven crown gear 24 can optionally be replaced by a disk. The links 49 that travel on the raceway 50 are also guided by their bearing 54 set that are hosted or received by the channel 59. Driver crown gear 23 and the driven crown gear 24 can be made from any suitable material, for example steel manufactured. The shaft for any of the crown gear 23 and the driven crown gear 24 can be made from any suitable material, for example steel or extruded cold rolled steel. The rowlock bearings can optionally be any commercial grade rowlocks suited for the job. The rowlock bearings or bearings of the driven crown gear 24 can optionally be provided with an adjustment mechanism (not illustrated), which can optionally include a steel profile angle and a metallic screw for adjustment with nuts. The foregoing permits adjustment of the tension on the conveyor belt 27, thereby adjusting the links 49. It is appreciated that any other suitable adjustment mechanism may be used, for example a handle and lever. The adjustment mechanism can be utilized to provide a smooth, precise, low friction conveyor arrangement suitable for a repeatable accurate location of the stacking towers 14 in a given position.

Figure 2:
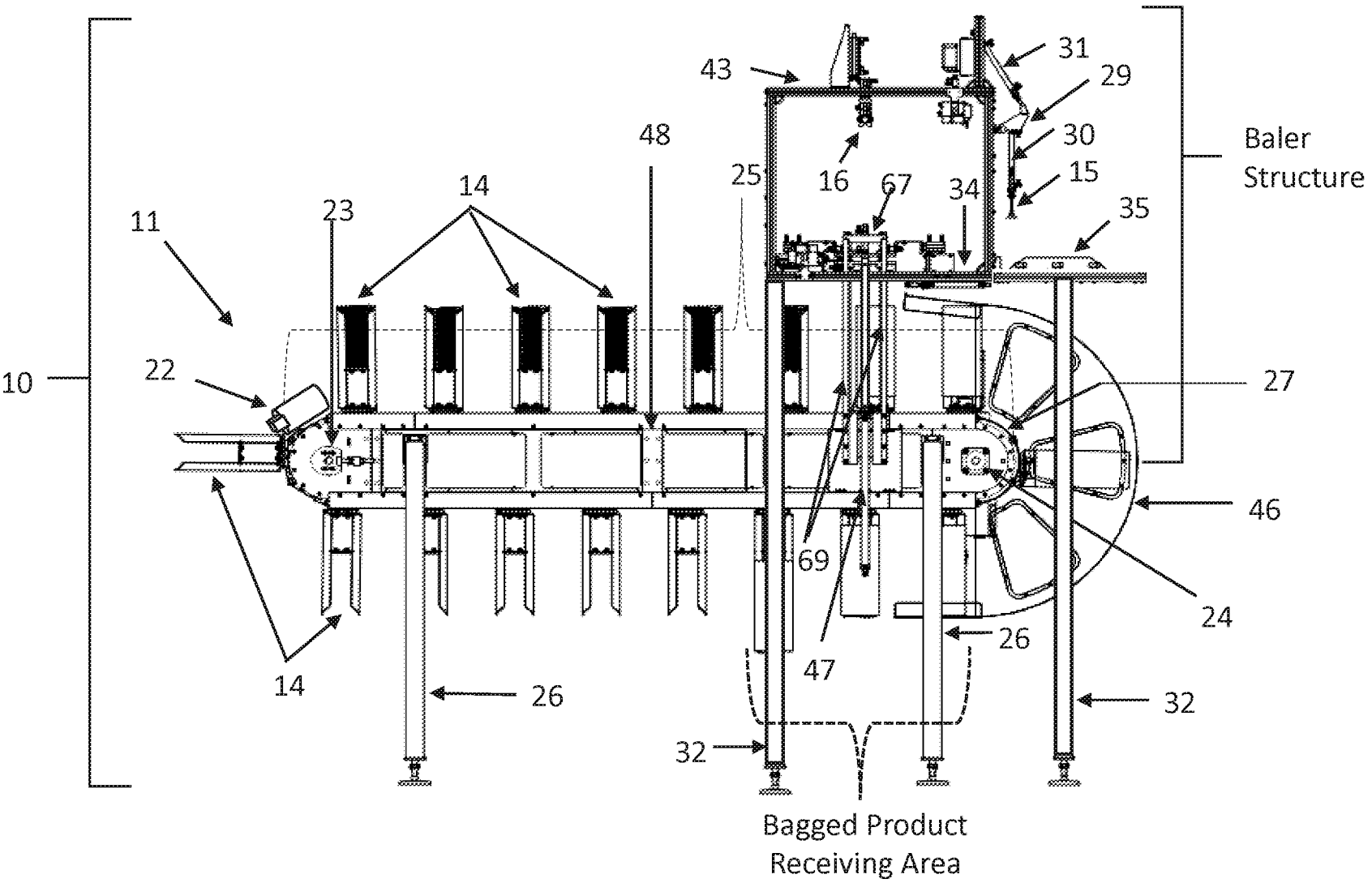
FIG. 2 is a side elevational view of the apparatus of FIG. 1 taken along the line 2-2 of FIG. 1.

The pair of parallel crossbars 48 of the chassis 25, illustrated in FIGS. 1, 2 and 6A, can optionally be supported by four legs 26 mechanically fixed to the sides of the crossbars 48 of the chassis 25, providing separation of the floor to the height of the stacking towers 14 which can additionally ensure an ergonomic height for the operator. The legs 26 can be manufactured from any suitable material, for example extruded steel or extruded aluminum. The legs 26 can optionally equipped on their lower part with an adjusting and leveling system (not illustrated), which may be formed from a plate disposed on the lower end of the leg 26 with a screw with a locknut, allowing the leveling of each leg 26.

The stacking towers 14, which can optionally be referred to as containers or transports, can optionally be formed from a hollow cylinder. The towers can be manufactured from any suitable material, for example stainless steel, an engineering thermoplastic, aluminum or any combination of the foregoing. Each tower 14 is provided with a chamber for receiving goods. The stacking tower 14 can optionally be provided with a vertical groove that runs from its base up to the upper cavity. On the lower part of the cylinder a base or plate can optionally be mounted (not shown), which can lend support to the goods placed in the stacking tower as well as serve as means for mechanically fix the stacking tower 14 to the upper face of a given link 49.

The driver crown gear 23 is powered by motor 22, which is optionally coupled to a gear box that allows control with a high degree of precision the position and speed of the conveyor belt 27 and stacking towers mounted to the conveyor belt. The motor 22 can be of any suitable type and is optionally of the servomotor type that enables position control with a high degree of precision. The motor can optionally be a stepper electric motor or an asynchronous squirrel cage rotor type. The motor 22 is electrically connected to a control system 28 (not illustrated). The control system 28 can be of any suitable type, for example a PLC (Programmable Logic Controller) or similar system. The control system 28 can optionally send pulses energizing the motor 22 for a determined time. The control system 28 can optionally energize the motor 22 until a mechanical switch, position or presence sensor detects that the stacking tower 14 is at a determined position. The mechanical switch or sensors are electrically connected to the control system 28, enabling the control system 28 to receive signals from the mechanical switch or sensors in order to carry out control operations. The motor 22 can optionally be a pneumatic motor connected to a pneumatic supply network (not illustrated), which may or may not be provided with a gear box. Such a pneumatic motor 22 can optionally be controlled by a pneumatic control valve (not illustrated) as well as by a flow regulator (not illustrated), which may be manual or automated controlled. The pneumatic control valve and flow regulator are electrically connected to the control system 28 for controlling the rotation and speed of the pneumatic motor 22.

Regardless of the type of motor 22, motor 22 is optionally mechanically fixed to the input shaft of a gear box, with the output shaft of the gear box mechanically fixed to the driver shaft of the driver crown gear 23. The gear box can be of any suitable type for the job. The output shaft of the motor 22 can optionally anchor a driver toothed pulley (not illustrated). On another axle, a driven toothed pulley can be mechanically fixed to the shaft of the driver crown gear 23. A toothed band (not illustrated) can join both driven and driver toothed pulleys. The pulleys may have various diameters for effecting the output speed of the driver shaft. The motor 22, regardless of type, can be mechanically fixed to the driver shaft that anchors the driver crown gear 23.

Figure 3:
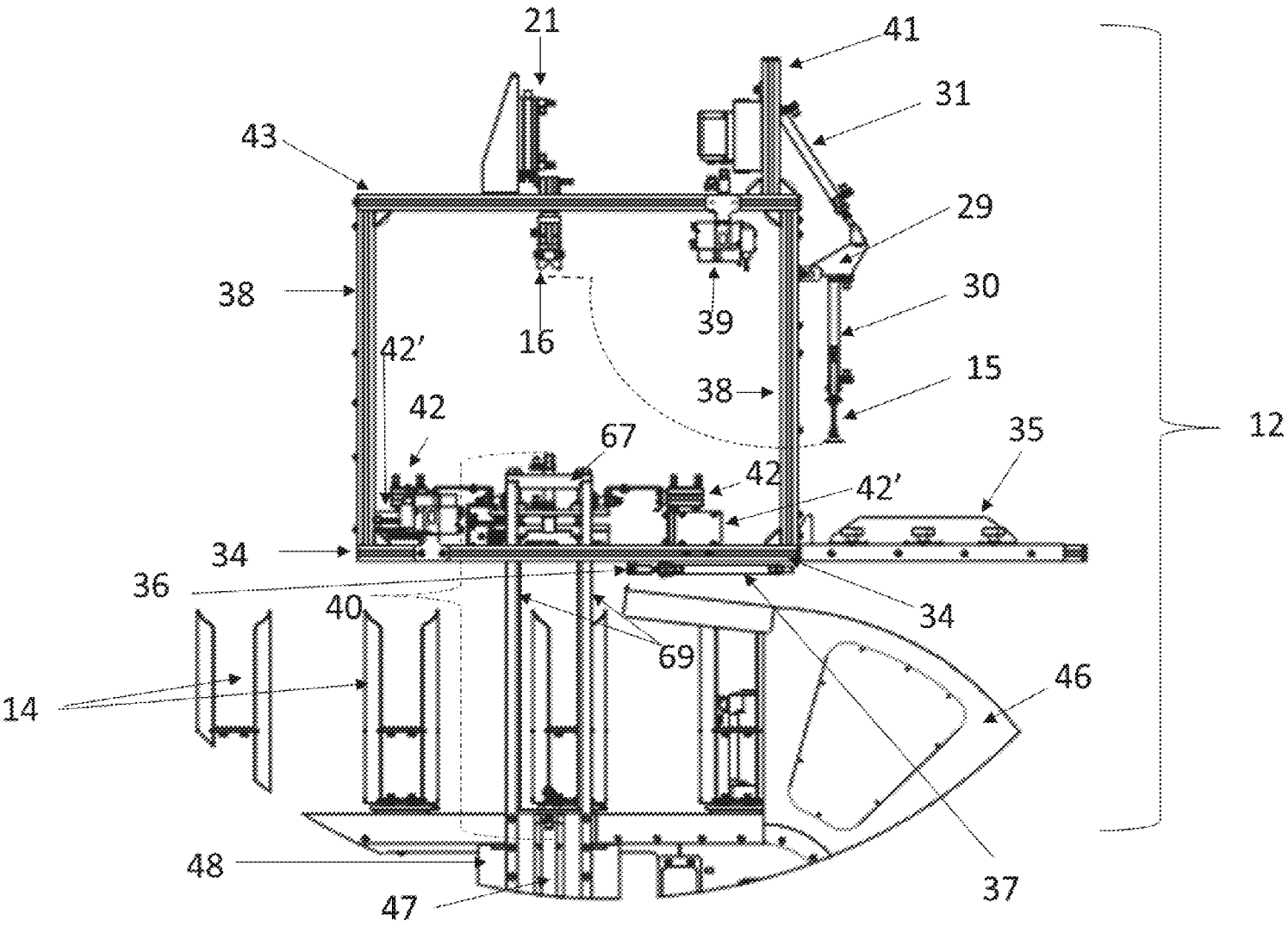
FIG. 3 is an enlarged view of a portion of FIG. 2 showing an embodiment of a baler of the apparatus of FIG. 1, where part of the baler ribbon as well as all the struts have been removed for clarity purposes.
Figure 4:
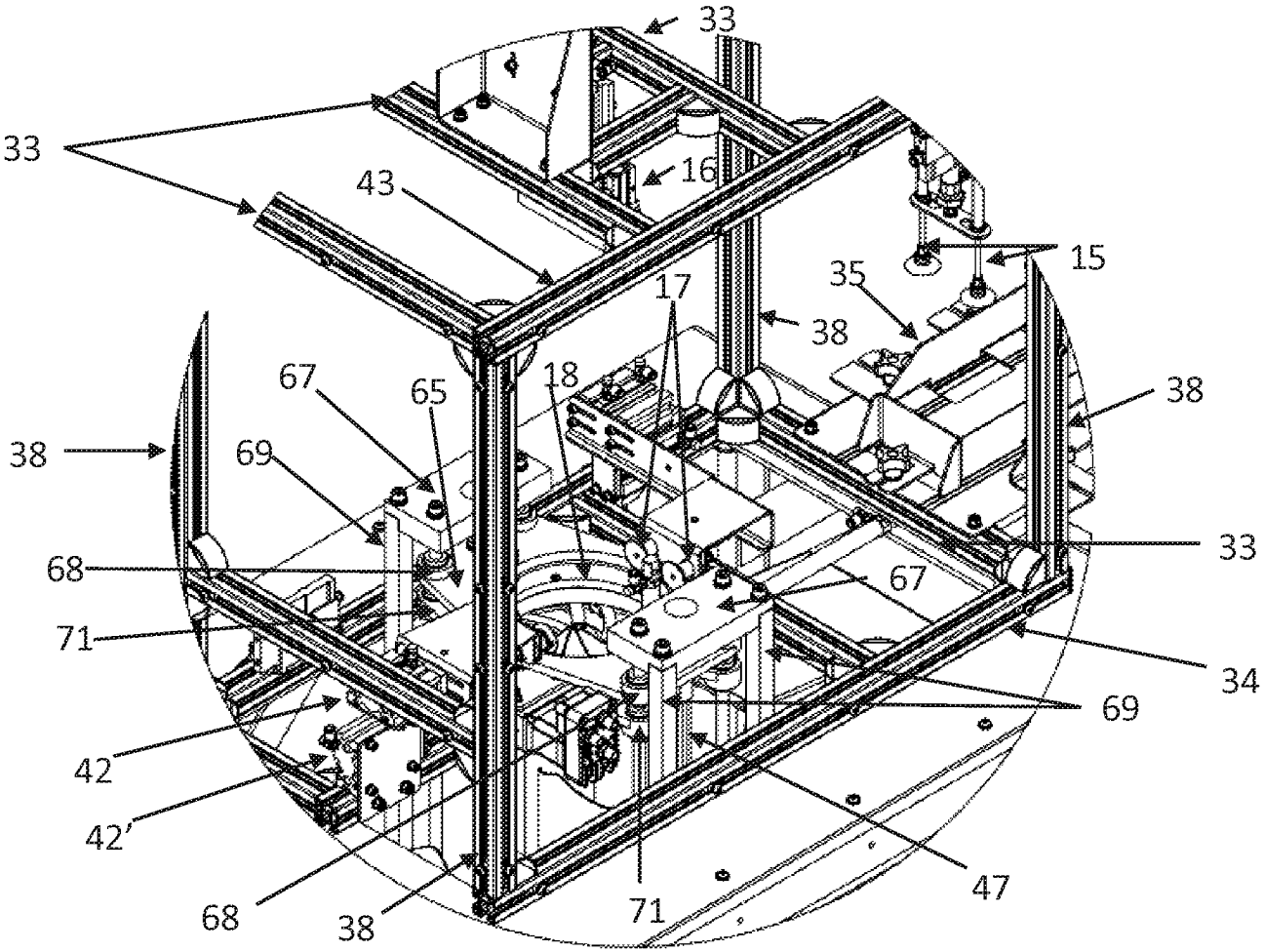
FIG. 4 is an isometric view of a portion of the baler of FIG. 3 illustrating an embodiment of an iris shutter within shrouding mechanism.

The second section of the apparatus 10 for packaging goods, illustrated in FIGS. 2, 3, is responsible for the veiling process of the apparatus, which can optionally be referred to as the covering process, the shrouding process, bagging, baling, packaging or any combination of the foregoing. The baler 12 is superimposed on or carried by the chassis 25 of the conveyor 11. The structure of the baler 12 is optionally made up by a cage that can include two pairs of struts 32 mechanically fastened on their upper ends to a pair of ribbons 34, which run parallel in a horizontal manner or direction. Two pairs of posts 38 are erected on the ribbons 34, being mechanically fastened at their lower end to the parallel ribbons 34. The upper ends of the pair of posts 38 are mechanically fastened to one pair of lintels 43 that run horizontally parallel to the pair of ribbons 34. One pair of lower cross pieces 33 are mechanically fastened to the ends of the pair of ribbons 34 (see FIG. 4). In the same manner, one pair or upper cross pieces 33 are mechanically fixed at the ends of the pair of lintels 43, as shown in FIGS. 1, 2 and 3. The cage also comprises one hinge panel 76 placed atop the pair of lintels 43. The hinge panel 76 provides support to the pneumatic cylinder 31 of the at least one hinge 29. The hinge panel 76 can include a pair of perches 41, with the lower ends of the perches 41 mechanically fixed to the pair of lintels 43. The upper end of the perches 41 are mechanically fixed by a cross piece 33 (shown in FIG. 1), which is mechanically fixed at its upper ends to the perches 41.

All of the structural components of the aforementioned cage that form the structure of the baler 12, such as the struts 32, the ribbons 34, the posts 38, the lintels 43, the perches 41 and the cross pieces 33, can each be made from any suitable material, for example manufactured in a structural steel profile, an aluminum profile or any combination thereof.

A tray 35 is optionally provided aside the structural cage of the baler 12. A multitude or plurality of covers, bags or packaging for packing can be placed atop the tray 35 for the package picking mechanism to utilize in the baling process. The tray 35 can be formed from any suitable material, for example an embossed sheet of steel or aluminum. An optional "C" shape channel is shaped longitudinally to provide rigidity to the tray. A piling mechanism can optionally be used on the tray 35, for example a slidable fin secured by screws or any other means. The slidable fin can allow for piling different bags, covers or packages, inhibiting or preventing a pile collapse. One transversal end of the tray 35 can be mechanically fixed to the baler 12 structural cage ribbon 34 and a lower transverse cross piece 33 (see FIG. 4).

The baler 12 can also be provided with a package picking mechanism of any suitable type, for example including a pneumatic suction cup or cups 15 set on the end of a pneumatic arm. One or more suction cups 15 can be provided, but for simplicity herein shall be referred to as a suction cup 15. The suction cup 15 can lift the covers, bags or packaging placed atop the tray 35 in order to locate them underneath the tweezer 16. This is possible due to the translation or extendable movement of the pneumatic or piston arm included in pneumatic cylinder 30, the suction cup 15 being mechanically fixed to the end of the piston rod. The other end of the pneumatic cylinder 30 is mechanically fastened to the pivotal hinge 29, which can have a scalene triangle shape as shown in FIG. 3. The hinge 29 pivots on the vertex joined by the hypotenuse by means of one pin or another appropriate fastening means that passes through a hole set for such purpose in the vicinity of the vertex. A hinge fin is mechanically fixed at a proper height on the post 38, wherein the pin is inserted and mechanically fixed onto the pin holder so as to allowing rotation of the hinge 29 on the pin axis.

A pneumatic cylinder 31 can be mechanically fixed to the upper vertex of the hinge 29, for example by means of a pintle. Cylinder 31 can include an extendable and retractable pneumatic piston or arm. The other end of the pneumatic cylinder 31 can be rotatably mechanically fixed to the hinge panel 76. This arrangement grants the pneumatic cylinder 31 a degree of freedom, being able to oscillate while the piston rod is ejected or is contracted from the housing of cylinder 31, which allows the hinge 29 to rotate over the pin axle. The trajectory of the hinge 29, pneumatic cylinder 30 and suction cup 15 can be seen as the dotted lines in FIG. 3. When the pneumatic arm of cylinder 31 is in its home or retracted position, and the pneumatic cylinder 30 is in its retracted position, the cylinder 30 transports the suction cup 15 to the vicinity of the tray 35 where a pile of bags, covers or packages are placed. The suction cup 15 at the end of cylinder 30 can be energized to seize a bag, cover or package from the pile. The pneumatic cylinder 30 can then be energized again to retracting its piston rod, and the pneumatic cylinder 31 can be energized to extend its piston rod so as to cause rotation of the pneumatic cylinder 30 (see FIG. 3 dotted line) and position the pneumatic cylinder 30 in a horizontal position. The pneumatic cylinder 30 is then energized again to extend its piston rod so as to leave the bag, cover or package within a grasping range of the tweezer 16. Once the bag, cover or packages is seized by the tweezer 16, the suction cup 15 is de-energized and the pneumatic arm of cylinder 30 returns to its home position. The hinge 29 and hinge fin can be made from any suitable material, for example a sheet, plate or shingle of steel or aluminum. The pin and pintle can be made from any suitable material, for example manufactured using cold rolled steel or extruded steel.

A pneumatic tweezer 16 can optionally be used for holding and hanging the covers, bags or packages when the suction cup 15 has been moved to its horizontal position, as shown by the dotted lines in FIG. 3. The tweezer 16 can have a jaw made from any suitable material, for example manufactured in some engineered thermoplastic such as nylon. The tweezer can optionally have undulations on its inner faces to be able to better grab the packaging covers, bags or packages. The tweezer 16 can optionally have a smooth surface and be manufactured from any suitable material such as rubber, a soft thermoplastic or vinyl to facilitate grabbing the packaging covers, bags or packages. The tweezer 16 can be mounted on the extendable piston or arm of the at least one pneumatic cylinder 21 for providing controlled vertical movement of the tweezer. The pneumatic cylinder 21 of the tweezer 16 has his own special support (not illustrated) that can be mechanically fastened to the pair of lintels 43.

The baler 12 includes a veiling system and method, which can optionally be referred to as a covering or shrouding system and method, that covers the goods containing or filled stacking tower 14. The method and apparatus of the invention utilizing stacking towers 14 advantageously reduces the handling of the goods, for example goods made from brittle fragile materials, and provides a gentle packing that reduces the risk of breaking the goods being handled for packaging. The method and apparatus of the invention advantageously covers, which can optionally be referred to as veiling or shrouding, the goods containing stacking tower 14 while the stacking tower 14 is still. The extraction, which can optionally be referred to as emptying, of the goods from the veiled stacking tower 14 can be under the force of gravity when the veiled staking tower 14 is inclined downwardly, for example upside down, so as to release or empty the goods from the tower into the package, cover or bag that has been placed over, for example to veil, cover or shroud, the stacking tower 14 (see FIG. 1). The veiling system and method of the invention can optionally include an elevator 40 that transports in a vertical manner a shutter (18 or 18'). When the elevator 40 goes down it transports the shutter (18 or 18') downwardly to veil, cover or shroud with a cover, bag or package the goods containing stacking tower 14 as said goods filled stacking tower 14 travels on the conveyor 11 into the shutter (18 or 18') inner cavity. The goods containing stacking tower 14 can optionally be placed colinearly underneath the shutter (18 or 18') to facilitate covering of the stacking tower by the shutter (18 or 18'). Once the elevator 40 has fully descended, the shutter (18 or 18') can loosen the veiling cover, bag or package and the elevator 40 can be directed to move upwards so s to move or return the shutter (18 or 18') to its home position.

The elevator 40 can optionally be placed between a pair of ribbons 34 and the crossbars 48 of the baler 12 cage. The lower part of the elevator 40 can be mechanically fixed to the crossbars 48. The elevator 40 is capable of transporting any of shutter (18 or 18') embodiments of the present invention, including shutter embodiments described herein. In any given embodiment the shutter (18 or 18') annular body (74 or 75) can optionally be mechanically fixed between, or sandwiched between, a fixing plate 65 and a counter plate 71. Both fixing plate 65 and counter plate 71 can have a set of bushings 68 that slide over the guide rods 70. The counter plate 71 can be mechanically fixed to a piston rod of the pneumatic cylinder 47. The counter plate 71 can optionally be mechanically fixed to a pneumatic cylinder 47 per side in such a way that a pneumatic cylinder 47 is mechanically fixed to a given crossbar 48. The fixing plate 65 and the counter plate 71 bushings 68 can optionally slide over a set of guide rods 70 that on their lower ends can optionally be mechanically fixed to the crossbar 48 and on their upper end can optionally be mechanically fixed to the cover 67. A pair of pillars 69 can optionally run parallel to the guide rods 70 so as to reinforce and stiffen the elevator 40 structure. The pillars 69 can optionally be mechanically fixed to the ribbon 34. When pneumatic cylinders 47 of the elevator 40 are retracted, they can serve to raise the shutter (18 or 18') set. When expanding or extending the pneumatic cylinders 47, the elevator 40 causes the shutter (18 or 18') set to descend.

The structural members of the elevator 40, for example the fixing plate 65, cover 67, guide rods 70 and counter plate 71, can each be made from any suitable material, for example steel, aluminum, an engineering thermoplastic or any combination of the foregoing. The fixing plate 65 and counter plate 71 bushings 68 can be made from any suitable material, for example brass or a suitable engineering thermoplastic such as nylon or auto-lubricating nylon.

The upper face of the annular body (74 or 75) of the shutter (18 or 18') can optionally be mechanically fixed to the fastening plate 65 only, so as to not utilize counter plate 71. As such, the bushings 68 for the guide rods 70 and the piston rod of the pneumatic cylinder 47 can be mechanically fixed to the fastening plate 65 in such a way that the shutter (18 or 18') set is raised when the pneumatic cylinders 47 of the elevator 40 are retracted and lowered when the pneumatic cylinders 47 the elevator 40 are expanded. The pneumatic cylinder 47 can optionally be mechanically fastened to one of the posts 38. Alternatively, the pneumatic cylinder 47 can optionally be mechanically coupled to each one of the posts 38. Alternatively, a plurality of pneumatic cylinders 47 operating in a parallel manner and fastened mechanically to each one of the posts 38 can optionally be provided. The pneumatic cylinders 47 of the elevator 40 can be of any suitable type, including "piston rod-less" type with magnetic couplings, that is piston rod-less pneumatic actuators, providing attachment and rigidity to the ensemble.

Some of covers, bags or packages ones hanging from the tweezer 16 may open their respective mouth, which can optionally be referred to as an opening or entrance, by themselves without further assistance so as to facilitate grabbing of the covers by the shutter (18 or 18'). In other cases when a cover, bag or package is hung upside down from the tweezer 16, assistance may be desired to open the cover, bag or package mouth so the shutter (18 or 18') is able to grab the cover, bag or package by their mouth and veil or cover the stacking tower 14. In this regard, an optional cover, bag or package mouth opening mechanism of any suitable type can be provided. The cover, bag or package mouth opening mechanism can optionally include a pair of suction cups 17 provided at the ends of the piston rods of the pneumatic cylinders 42 (see FIGS. 3, 4). The pneumatic cylinders 42 can optionally be mounted and fastened mechanically over a base, for example having a rectangular geometry, with a pair of "U" shaped vertical protuberances having upper parts constructed from any suitable material, for example a thermoplastic, aluminum, steel or any combination of the foregoing. The rectangular "U" shaped base protuberance can support the pneumatic cylinder 42 in between the vertical protuberances. The back end of the pneumatic cylinder 42 can be mechanically fastened to the "U" shaped base protuberance. The other end of the pneumatic cylinder 42 can be supported on a fork formed at the front protuberance, which permits the piston rod of the pneumatic cylinder 42 to easily extend and retract. The rectangular base houses a pneumatic cylinder 42', with the piston rod of said pneumatic cylinder 42' being mechanically fastened to the front vertical side of the rectangular base. The front vertical side can optionally be collinear with the upper front protuberance with a fork shape that supports the front part of the pneumatic cylinder 42. The rear vertical side of the rectangular base can have a through hole permitting the pneumatic cylinder 42' to loosely pass through. The rear part of the pneumatic cylinder 42' can be mechanically fastened to a "T" support that is mechanically fastened atop the ribbon 34. The ribbon 34 of the baler 12 optionally has a "T" shaped longitudinal channel that allows the rectangular base on its lower end to have a nipple with a rectangular cross section that slides longitudinally over the ribbon 34. Accordingly, extraction or extension of the piston rod of the pneumatic cylinder 42' translates the rectangular base of the pneumatic cylinder 42 so as to move the pneumatic cylinder 42. This arrangement provides a "tandem" arrangement of the pneumatic cylinders 42 and 42', which can facilitate accurate operation of the suction cups 17. The bag, cover or package mouth opening mechanism can optionally include a pneumatic cylinder 37 located underneath the shutter (18 or 18'). At least one blower 36 can be mechanically fastened on the end of the piston rod of the pneumatic cylinder 37. The pneumatic cylinder 37 body can be mechanically fixed to a support which in turn can be mechanically fixed between the ribbons 34. Accordingly, retraction of the piston rod of the at pneumatic cylinder 37 allows the free passage of the shutter (18 or 18') in its vertical trajectory defined by the elevator 40.

When a packaging cover, bag or package is hung upside down from the tweezer 16, the cover, bag or package mouth opening mechanism can optionally operate as follows. The pneumatic suction cups 17 can approach the closed mouth of the cover, bag or package located at the lower end of the baler 12. Extraction or extension of the piston rods of the pneumatic cylinders 42, 42' causes the suction cups 17 to get sufficiently near to the upper part of the cover, bag or package so that the vacuum of the suction cups 17 can seize the upper part. When the pneumatic cylinder 42 is retracted, the mouth of the cover, bag or package is opened, for example opened wide. The pneumatic cylinder 37 can be energized so as to expel or extend its piston rod, thereby placing the blower 36 in position under the shutter (18 or 18'). Activation of the blower 36 introduces air into the cover, bag or package, causing it to inflate. Following such inflation, the blower 36 can be de-energized and the pneumatic cylinder 37 retracted. The suction cups 17 can also be de-energized and the pneumatic cylinders 42 and 42' retracted and returned to their home positions. The shutter (18 or 18') can be energized to cause the mouth of the cover, bag or package to adhere to the inner wall of the annular body (74 or 75) so as to secure the mouth of the cover, bag or package.

Figure 5:
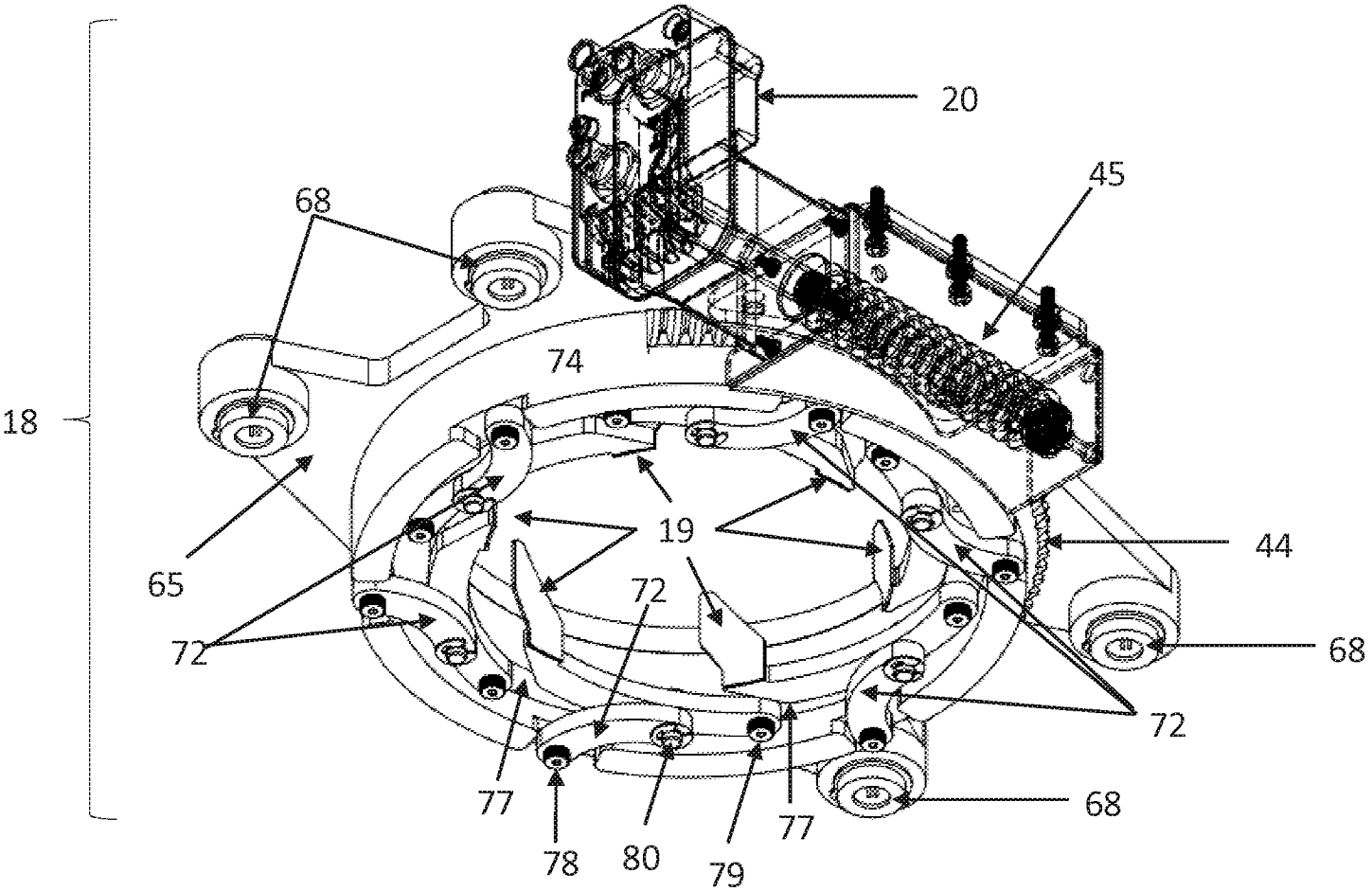
FIG. 5 is an isometric view of the lower part of the iris shutter of FIG. 4.

The method and apparatus of the invention can include a shutter set mechanism of any suitable type, for example shutters (18 or 18') set mechanisms. An embodiment of iris shutter 18 is illustrated in FIG. 5. The iris shutter 18 can optionally include a worm gear 45 and crown gear 44 mechanism that operate a series of fingers 19. The crown gear 44 can be housed by an annular body 74, exposing the crown gear 44 teeth through the outer cylindrical wall window of the annular body 74. A motor 20 can be mechanically coupled to the worm gear 45. Energizing the motor 20 it powers the worm gear 45, that is engaged with the crown gear 44, so as to cause the crown gear 44 to be angularly displaced within the annular body 74. The crown gear 44 can include an inner ring 77 that protrudes radially from its inner cylindrical face going beyond the annular body 74 inner cylindrical wall through a slot provided for such purpose. A series of threaded holes can be provided on the inner ring 77 bottom face for allocating a series of fulcrum 79 screws for rotatably fixing the fingers 19. The inner ring 77 can be mechanically fitted to rotate in relation of the fixed annular body 74, thus providing movement to the fingers 19. The fingers 19 can be provided with a curved shape with a curved paddle on a distal end and a through hole on the proximal end. Another thru hole can be disposed on the curved body, which can optionally have a rectangular cross section.

Operation of the components of the iris shutter 18 can be as follows. As shown in FIG. 5, fingers 19 can be pivotally fixed to the inner ring 77 by means of a fulcrum 79 having a steel shoulder bolt. The fulcrum 79 can be screwed into the threaded holes of the inner ring 77, allowing the fingers 19 to rotate around the fulcrum 79 and be angularly translated in relation of the annular body 74. A phalanx 72 that serves as connector between the annular body 74 and finger 19 can optionally be provided to limit the angular translation of a given finger 19. The phalanx 72 can have a curved shape with first and second ends with through holes, discussed below. A series of grooves can optionally be carved in the bottom face of the annular body 74 (see FIG. 5). The grooves can be provided with a threaded hole for hosting, carrying or receiving a kingpin 78 screw that rotatably secures a first end of the phalanx 72. The kingpin 78 can optionally be a steel shoulder bolt. The second end of the phalanx 72 can be rotatably tied to the finger 19 body by means of safety pin inserted on the through hole of the finger 19 body. The safety pin can be provided with a safety washer for better or fully securing the safety pin.

Movement of the iris shutter 18 can be as follows. Energizing the motor 20 powers the worm gear 45, causing an angular movement of the crown gear 44, which angularly translates the fingers 19 in relation of the annular body 74 so that the fingers get closer to the phalanx 72. This action causes the phalanx 72 to be subjected to a compression force that pushes the fingers 19 radially inwardly towards the center of the annular body 74. When the motor 20 rotates in a different direction, the crown gear 44 engaged with the worm gear 45 angularly travels in a counter direction, which causes the holed end of the finger 19 to move angularly away of the phalanx 72. This action causes the phalanx 72 to be subjected to a tension force that pulls the body of the fingers 19 radially towards the inner wall of the annular body 74. When the curved palettes of the fingers 19 travel radially towards the inner wall of the annular body 74 they catch and hold the mouth of the cover, bag or package against the inner wall of the annular body 74. The fingers 19 and the phalanx 72 can be made from any strong but lightweight material, for example aluminum, steel, an engineering thermoplastic or any combination of the foregoing. Both the fingers and the phalanx can optionally have a rectangular or square cross section.

Figure 8:
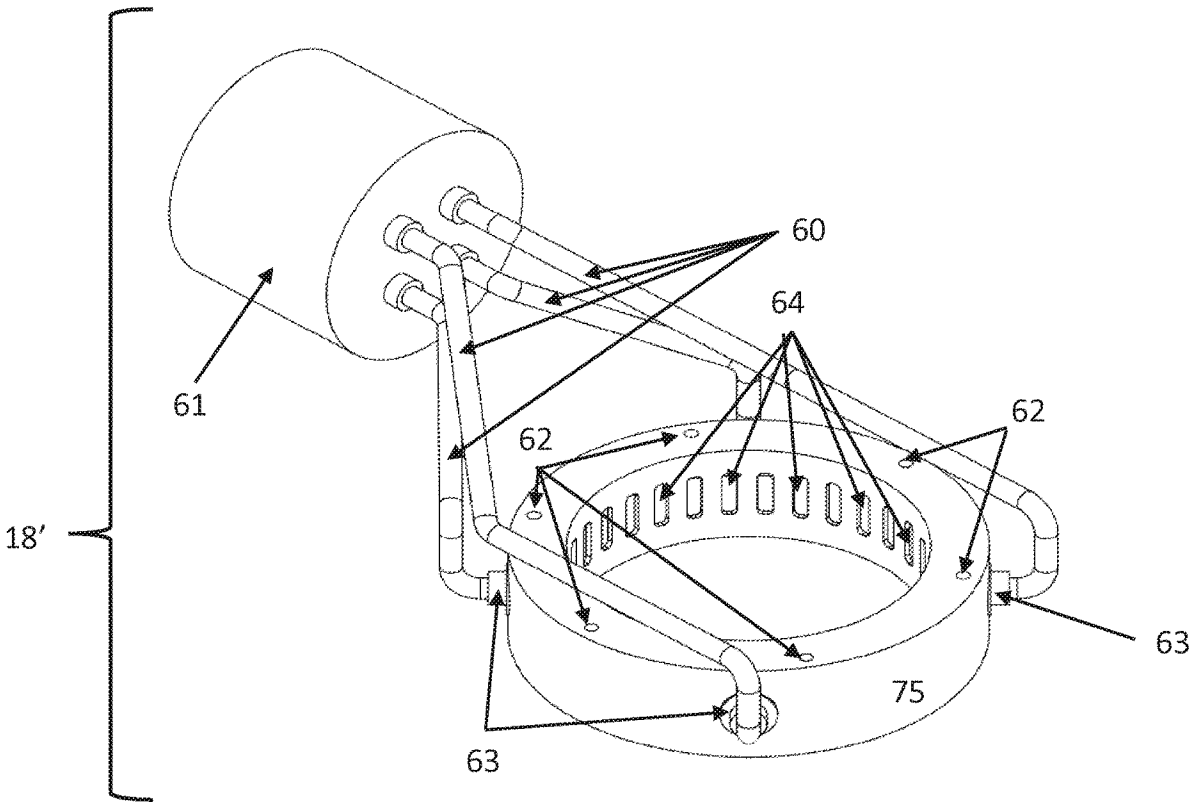
FIG. 8 shows an isometric view of an embodiment of a suction shutter of the baler of the apparatus of FIG. 1.

In an alternative embodiment, the iris shutter 18 can optionally be replaced by a shutter based on suction or vacuum. Such an embodiment can advantageously minimize the mobile parts of the shutter so as to reduce possible failure modes of the shutter. As can be seen from FIG. 8, the suction shutter 18' can be formed by an annular body 75 having a toroidal geometry fashion with cylindrical walls covered on its lower and upper parts with washer-like or other discs. Such a construction or configuration forms a hollow annular body 75 having a chamber between the interior and exterior cylindrical walls in addition to the upper and lower washers. A plurality of ports 64 can be carved over or in the inner cylindrical face of the annular body 75 so as to allow air flow towards the inner part of the annular body 75 chamber for creating an air current in the vicinity of the ports 64 which will tend to suction any object in its vicinity. Upon placing a relatively open cover, bag or package mouth in the inner diameter of the annular body 75 of the suction shutter 18' the outer part of the cover, bag or package mouth can be suctioned by the air that flows through the ports 64 so as to cause the outer part of the cover, bag or package mouth to stick to the outer face of the inner cylindrical wall that contains the ports 64 of the annular body 75 of the suction shutter 18'. The air that is suctioned through the ports 64 can optionally be collected in a uniform manner within the chamber to later be suction fetched by the suction ports 63 set in an equidistant manner on the outer face of the outer wall of the annular body 75. Each suction port 63 can be pneumatically coupled to a suction duct 60 which can transport the air towards the vacuum generator 61. Once the mouth of the cover, bag or package obstructs the ports 64, the air flow towards the vacuum generator 61 decreases, causing negative pressure within the annular body 75 chamber as well as within the ducts 60 so as to fasten the mouth of the cover, bag or package against the outer face of the inner wall of the annular body 75. The vacuum generator 61 may function by means of a fan, a compressor, a Venturi tube or any other suitable mechanism which allows air suction or vacuum generation in the suction ducts 60. The vacuum generator is electrically connected to the control system 28, so that it is capable of being energized and controlled by the system 28. The suction ducts 60 may be tubes may be made from any suitable material, for example extruded from aluminum, steel, copper, a thermoplastic such as PVC, polyethylene or polypropylene or any combination of the foregoing. The suction ducts 60 can optionally be flexible hoses made of vinyl or rubber. The annular body 75 of the suction shutter 18' can be made from any suitable material, for example extruded steel or aluminum, for forming the outer and inner cylindrical walls. The washers of the upper and lower faces can optionally be manufactured of the same material as the outer and inner cylindrical walls, and can optionally be welded together.

In suction shutter 18', the upper face of the annular body 75 can optionally be provided with a plurality of threaded holes 62 for fastening the suction shutter 18' to a fastening plate 65 by means of any suitable fasteners such as screws. The threaded holes 62 can optionally number between three and nine. Alternatively, the plate 65 can optionally be mechanically fixed to the upper face of the annular body 75. The annular body 75 can optionally be provided with a series of threaded holes in his bottom face (not shown) for permitting the annular body to be fixed to the counter plate by any suitable fasteners such as screws. The threaded holes 62 can optionally number between three and nine. In this embodiment, the annular body 75 is "sandwiched" and fixed by fasteners to the fixing plate 65 and the counter plate 71.

The conveyor 11 optionally maintains a stacking tower 14 coaxially aligned under the shutter (18 or 18'). Once the shutter (18 or 18') have secured the mouth of the cover, bag or package, the pneumatic cylinders 47 of the elevator 40 can be energized to descend the elevator 40 and cause the shutter (18 or 18') to cover, veil or shroud goods containing stacking tower 14 placed axially colinear underneath the shutter (18 or 18') at that moment with the cover, bag or package. In this regard, the stacking towers can optionally be mounted at right angles or perpendicular to the conveyor belt 27. The elevator 40 and shutter (18 or 18') can be controlled, configured or both to cover, veil or shroud at least the opening of the chamber in the stacking tower, at least a portion of the length of the stacking tower, the entirety of the length of the stacking tower or any combination of the foregoing. Once the stacking tower 14 has become veiled or covered by the cover, bag or package, the shutter (18 or 18') can release the mouth of the cover, bag or package. The pneumatic cylinders 47 of the elevator 40 can then optionally be activated to lower the shutter (18 or 18'), fully releasing the mouth of the cover, bag or package in its entirety. The shutter (18 or 18') can then optionally be retracted to its home position, in which the mechanisms of the shutter allow clearance between the inner wall of the annular body (74 or 75) and the veiled stacking tower 14. The pneumatic cylinders 47 of the elevator 40 can be energized to elevate the elevator 40, with the shutter (18 or 18'), back to its home position underneath the tweezer 16.

In an alternative embodiment (not shown), the staking towers 14 can be mounted to the conveyor belt 27 in an inclined position relative to the conveyor belt. In such an embodiment, the stacking towers are not vertically disposed. Such stacking towers can optionally have an angle between 30° to 90°, or between 30° to 89°, with respect to the horizontal or the crossbars 48. The stacking towers 14 can optionally be provided with a hinge in their lower part that is mechanically fixed to the base or lower part of the stacking tower 14. The other end of such a hinge can be mechanically fixed to the conveyor belt 27, for example the upper face of the links 49 of the conveyor belt. The base of the stacking tower 14 can optionally not be parallel to the horizontal or to the upper face of the links 49 but mounted to the conveyor belt 27 at any suitable fixed angle with respect to the conveyor belt or links. In such an embodiment, the base of the stacking tower 14 can optionally be mechanically fixed to the upper face of the links 49. In such an embodiment, the stacking towers 14 can optionally travel on the chassis 25 of the conveyor 11 with any suitable inclination of less than 90°, for example between 30° to 89°, with respect to the horizontal or the crossbars 48. In any embodiment, the stacking tower 14 conveyor 11 can optionally maintain a stacking tower 14 coaxially aligned under the shutter (18 or 18'). For example, the structure of the baler can be provided with the same inclination as the stacking towers 14, for example the ribbon 34 is inclined causing the inclination of the pillars 69 of the elevator 40. The inclination of the ribbon 34 can optionally be obtained by hinging the joint between the ribbons 34 and the struts 32 in the vicinity of the posts 38. The struts 32 located below the tray 35 can optionally be provided with a series of through holes, for example with a constant spacing between them, for receiving respective pins and holding or retaining the struts 32 with the ribbon 34 that is provided with a fin for this purpose. The pillars 69 can optionally be hinged to the crossbars 48. In an alternative embodiment, the pillars can optionally be mechanically fixed to said crossbars 48 with the same inclination as the stacking towers 14, so that the shutter (18 or 18') travels in a collinear manner with the stacking tower 14.

Once the goods containing stacking tower 14 has been veiled, and the elevator 40 with the shutter (18 or 18') is at its home position, the motor 22 of the conveyor 11 can be energized so as to cause the stacking towers 14 on the conveyor belt 27 to advance. The motor 22 can be energized until the next goods containing stacking tower 14 is coaxially located under the shutter (18 or 18'). The veiled or otherwise covered stacking towers 14 continue traveling on the conveyor band or belt 27 to the "Bagged Product Receiving" area, which can optionally be located on the lower end of the conveyor under the baler 12 structure (see FIGS. 1, 2). It is appreciated that the "Bagged Product Receiving" area can be located under any location on the conveyor system 11 where the covered stacking towers 14 are in a position inclined downwardly relative to horizontal in which the goods in the towers can empty or discharge into the bag or package under the force of gravity, the bag with goods therein can slide off of the stacking tower under the force of gravity or both, in one embodiment of the invention, the "Bagged Product Receiving" area is at a point nearby the baler structure 12. The "Bagged Product Receiving" area can optionally be comprised by the lower part of the conveyor 11 on which the entire trajectory or travel of the stacking towers 14 are upside down. When stacking towers 14 are sufficiently inclined downwardly, including being "upside down," both the covers, bags or packages and the goods can be freed from the stacking tower 14 under the force of gravity. For example, the bag or package of goods and fall or unload into a box or a container or another appropriate means for this end.

The baler 12 structure can optionally include a dumping arch 46, as illustrated in FIGS. 1, 2, which can optionally be formed by a wall with an inner arch shape or track that is guarded by a pair of sides which follow the shape of the track. The sides can be mechanically fixed to the track. The pair of sides as well as the track can be manufactured from any suitable material, including stainless steel, aluminum, nylon or any combination of the foregoing. The dumping arch 46 can be mechanically fixed to the strut 32 of the baler 12 structure in any suitable manner, for example by way of welding, binder, screws with nuts, rivets or any combination of the foregoing. The dumping arch 46 can optionally cover the trajectory of the goods containing stacking towers 14 that have been veiled or covered, for example extend from right after the area of the shutter (18 or 18') from the immediate posterior veiled stacking tower 14 until the stacking tower 14 is turned upside down, or otherwise inclined downwardly, up to the bagged product receiving area. The dumping arch 46 can optionally have a constant gap between the upper end of a stacking tower 14 and the inner arch shaped wall or track. The gap can be of any suitable size, for example vary from between 0.5 cm to 2.0 cm, depending on the type of product to be bagged. After the goods containing stacking tower 14 has been veiled or covered in the baler 12 area it continues its travel on the conveyor system 11 so as to enter the dumping arch 46 zone, which can inhibit the covers, bags or packages as well as the goods from departing or escaping from the veiled and goods containing stacking towers 14 while the stacking towers are inclined downwardly or turned upside down for emptying. When the veiled and goods containing stacking tower 14 reaches the bagged product receiving area, the dumping arch 46 ends, thus permitting the covers, bags or packages with the goods therein to freely slide off of or otherwise depart or exit from the stacking tower 14 taking advantage of the effect of gravity on the covers, bags or packages and the goods.

All the pneumatic actuators discussed herein, such as the pneumatic cylinders, the pneumatic motors, the suction cups, the blowers or any combination thereof, can optionally include limit switch sensors and can optionally be controlled by means of any suitable pneumatic valve, for example of the 5 way, the 2 position type, 4 way and 2 position type, 5 way and 3 position type or any combination of the foregoing. The pneumatic actuators can optionally be piloted by means of a solenoid, for example electro valves, which can be pneumatically connected in a fluid manner to the actuators, for example the pneumatic cylinders or motors. The limit switch sensors and the electro valves are electrically connected to the control system 28, so that the control 28 receives the signals from the limit switch sensors to be able to process them. The control system is also capable of energizing or de-energizing the electro valves in a controlled manner for bagging products in the desired manner, or example as disclosed herein. In an alternative embodiment, the pneumatic cylinders herein, including pneumatic cylinders 21, 30, 31, 37, 42, 42', 47 or any combination thereof, may optionally be of the magnetic pneumatic type. In another alternative embodiment, the pneumatic cylinders herein, including pneumatic cylinders 21, 30, 31, 37, 42, 42', 47 or any combination thereof, as well as the tweezers 16, can optionally be electric and connected to a driver which controls the actuators. The drivers can be electrically connected to the control system 28 so that the system 28 may selectively energize or de-energize the drivers. The electric actuators can optionally be electrically connected to the control system 28 without mediating with drivers. The control system 28 can be of any suitable type, for example a programmable logic controller (PLC). The solenoids of the valves can be connected directly to the analog exit of the PLC, with the analog exits of the PLC being electrically connected to a suitable power source. The control system 28 can optionally be a processor or microprocessor connected electrically to a power stage, with a suitable piloted switch such as a solenoid relay, a transistor, an insulated gate bipolar transistor, an optical switch, a Mosfet or any combination of the foregoing for receiving a signal or pulse emanating from the processor or microprocessor to energize the piloted switch. The piloted switch can be connected on its power side to a power source capable of energizing the actuator, which can be of any suitable type such as a solenoid.

The motors disclosed herein can optionally be directly connected to the analog exit of the PLC of the control system 28, wherein the analog exit is electrically connected to a power source. The control system 28 can optionally be processor or a microprocessor, in which case the motors can be connected as disclosed in the preceding paragraph Where pneumatic motors are used, the pneumatic motors can be pneumatically coupled to an electro valve, which can allow or restrict the compressed air flowing towards them. The electro valves can in turn be electrically connected to the control system 28, so that they may be energized or de-energized by the control system 28.

The pneumatic system herein can include a compressor, a tank, a maintenance unit, a flow regulator and any other necessary accessories for operating and distributing compressed air to the electro valves, as well as to the actuators, for example the pneumatic cylinders, the motors, the suction cups, the blower or any combination of the foregoing.

Any of the pneumatic cylinders disclosed herein can optionally include, for example on the outside or on the inside of the body of the cylinder, a position sensor of any suitable type, or example a micro switch type, a magnetic sensor, a capacitive sensor, an inductive sensor or any combination of the foregoing. The position sensors can be electrically connected to the control system 28, so that it is possible to receive signals from the sensors and respond as a function of the signals. The sensors set over the baler structure 12, as well as those set on the conveyor, may optionally be of the micro switch type, a magnetic sensor, a capacitive sensor, an inductive sensor or any combination of the foregoing. The position sensors can be electrically connected to the control system 28, so that the control system can receive the signals from the sensors and respond as a function of the signals.

A method of bagging or packaging products has been provided, and can include the steps of placing the goods in one or more stacking towers, advancing the stacking tower to a certain position, for example by activating a conveyor belt until the immediately preceding goods containing stacking tower is collinear with the center of a shutter, approaching a stack or pile of covers, bags or packages set over the tray with a suction cup, for example by energizing a pneumatic cylinder, grabbing a cover, bag or package and delivering it to a tweezer 16, for example by energizing the suction cup and rotating a pneumatic arm, holding the cover, bag or package by the tweezer, returning the suction cup to a home position, for example by returning the pneumatic arm to its home position, opening the mouth of the cover, bag or package, for example by energizing the suction cup and a mouth opening mechanism, blowing air into the cover, bag or package with a blower 36, for example by energizing a pneumatic cylinder and a blower, grasping the opened mouth with the shutter, positioning the shutter to seize the open mouth of the cover, bag or package and energizing the shutter to hold the opened mouth of the cover, bag or package against an inner cylindrical wall of an annular body, de-energizing and returning home the suction cup 17 and blower 36, for example by de-energizing the suction cup and the blower and energizing a mouth opening mechanism commanding, veiling or covering the goods filled stacking tower, for example by lowering an elevator that vertically transports the shutter so as to cause the veiling or covering of the goods containing stacking tower with the cover, bag or package seized by the mouth by the shutter, releasing the mouth of the cover, bag or package, for example once the goods containing stacking tower has been veiled the shutter gets actuated in order to loosen the seized mouth of the cover, bag or package and assure a clearance between the veiled or covered stacking tower and the inner cylindrical wall of the annular body, returning the shutter to its home position, for example by energizing the elevator so as to cause the elevator to raise to its home position, and optionally repeat the foregoing steps.

An apparatus for packaging products has been provided, and can include a conveyor with a conveyor belt having a series of stacking towers mechanically secured or fixed to the conveyor belt, a baler comprising a tray, wherein the covers, bags or packages or packages are placed, a cover, bag or package picking mechanism that picks the cover, bags or package from the tray and delivers it to a tweezer where the cover, bag or package hangs seized by the tweezer, a cover, bag or package mouth opening mechanism that opens the closed cover, bag or package mouth and blows air to the interior of the cover, bag or package, an elevator placed collinearly to a staking tower that transports a shutter that seizes the tweezer hanging cover, bag or package by its mouth and veils or covers a stacking tower, and a bagged product receiving area where the goods and cover, bag or package is detached from the veiled stacking tower due to gravity, leaving the goods within the cover, bag or package.

The shutter can optionally be an iris shutter with fingers and phalanges. The shutter can optionally be a suction shutter with a series of suction ports. The cover collection mechanism can optionally include a suction cup placed on an end portion of a pneumatic arm. The pneumatic arm can optionally include a first pneumatic cylinder fixed at a vertex of a hinge and the rod has mechanically attached a suction cup, a second pneumatic cylinder whose end is mechanically attached to a hinged panel and its rod is mechanically attached to another vertex of the hinge, the remaining vertex of the hinge being mechanically attached to a hinge fin arranged on a post, promoting rotation of the hinge and first pneumatic cylinder when energizing the second pneumatic cylinder. The bag mouth opening mechanism can optionally include first and second pneumatic cylinders arranged in tandem one above the other, the rod of the first pneumatic cylinder has arranged in its end a pair of pneumatic suction cups, a third pneumatic cylinder whose rod mechanically supports a pneumatic blower. The stacking towers as well as the elevator can optionally each have an inclination ranging from 30° to 89°.

A method for packaging products using the apparatus of the invention has been provided, and can include the steps of placing goods in a stacking tower, advancing the stacking tower to a certain position by activating the conveyor belt until the immediately precedent goods containing stacking tower is found collinear with the center of the shutter, moving the suction cup to the pile of covers, bags or packages set over the tray by energizing the pneumatic cylinder, grabbing a cover, bag or package and delivering it to the tweezer by energizing the suction cup and rotating the pneumatic arm, holding the cover, bag or package by the tweezer, returning the suction cup to its home position by returning the pneumatic arm to its home position, opening the mouth of the cover, bag or package by energizing the suction cups and the mouth opening mechanism, blowing air into the cover, bag or package by the blower, for example by energizing pneumatic cylinder (37) and blower (36), grasping the open mouth by positioning the shutter to seize the open mouth of the cover, bag or package and energizing the shutter to hold the opened mouth of the cover, bag or package against the inner cylindrical wall of the annular body, de-energizing and returning home the suction cups and blower by de-energizing the suction cups and blower (36) and energizing the mouth opening mechanism commanding it to its home position, veiling or covering the goods containing stacking tower by lowering the elevator, which vertically transports the shutter promoting the veiling or covering of the goods containing stacking tower with the cover, bag or package seized by the shutter, releasing the mouth of the cover, bag or package, once the goods containing stacking tower has been veiled or covered, the shutter is actuated in order to release the seized mouth of the cover, bag or package to assure a clearance or gap between the veiled stacking tower and the inner cylindrical wall of the annular body, returning the shutter home, for example by energizing the elevator so as to cause the elevator to raise to its home position, and optionally repeating the foregoing steps.

The method and apparatus of the invention can carefully stacks a brittle or fragile goods in a tower or container. The tower or container can be gently shrouded, covered or veiled with an appropriate wrapping, for example by a shutter system. The method and apparatus of the invention can decrease product waste, saving time and easing handling and packing procedures. The method and apparatus of the invention addresses issues pertaining to the baling, bagging or packaging of goods, for example brittle fragile foods, wherein the consumer expects to find the goods or products whole and not broken within the packages.

The method and apparatus of the invention has been described with sufficient detail to enable a person skilled in the art to reproduce the invention. The method and apparatus of the invention have a high degree of industrial application, as well as inventive activity. It is appreciated that a person skilled in the art will be able to glimpse alternative embodiments of the method and apparatus of the invention, which must be considered to lie within the scope and spirit of the claims.

We claim:

1. An apparatus for use with a plurality of empty packages with respective mouths to package a plurality of fragile goods, comprising a conveyor with a conveyor belt having a length, a series of stacking towers spaced along the length of the conveyor belt and secured to the conveyor belt, each of the stacking towers having a chamber adapted for receiving fragile goods, a first drive gear coupled to the conveyor belt for advancing the stacking tower with goods in the chamber to a baler, the baler including an elevator placed collinearly with the stacking tower secured to the conveyor belt with goods in the chamber configured to place a mouth of one of the plurality of empty packages over the stacking tower with goods in the chamber, the elevator transporting a shutter that seizes the package by its mouth, and the conveyor configured so that further advancement of the conveyor belt by the first drive gear causes the stacking tower to tilt so that the goods slide into the package and the package slides off the stacking tower, in each case under the force of gravity, whereby the elevator facilitates precise collinear placement of the empty package over the stacking tower with goods in the chamber.

2. The apparatus of claim 1, further comprising a second drive gear, wherein the conveyor belt is an endless conveyor belt extending between the first drive gear and the second drive gear.

3. The apparatus of claim 1, wherein the baler includes a tray for storing a plurality of empty packages, a package picking mechanism for removing one of the plurality of packages from the tray and a package mouth opening mechanism that blows air through the mouth of the package to expand the package before placement of the package over the stacking tower.

4. The apparatus of claim 3, wherein the package picking mechanism includes a suction cup on an end of a pneumatic arm.

5. The apparatus of claim 4, wherein the pneumatic arm includes a rod mechanically attached to the suction cup and a first pneumatic cylinder fixed at a first vertex of a hinge, a second pneumatic cylinder having a rod mechanically attached to a second vertex of the hinge and having an end mechanically attached to a hinged panel, the hinge having a third vertex mechanically attached to a hinge fin arranged on a post for promoting rotation of the hinge and first pneumatic cylinder when energizing the second pneumatic cylinder.

6. The apparatus of claim 3, wherein the package mouth opening mechanism includes first and second pneumatic cylinders arranged in tandem one above the other, the first pneumatic cylinder having a rod with an end having a pair of pneumatic suction cups, a third pneumatic cylinder having a rod that mechanically supports a pneumatic blower.

7. The apparatus of claim 1, wherein the shutter is selected from the group consisting of an iris shutter with fingers and phalanges and a suction shutter with a series of suction ports.

8. An apparatus of claim 1, wherein the elevator is configured to veil the stacking tower on the conveyor belt entirely with the empty package.

9. The apparatus of claim 1, wherein each of the series of stacking towers is fixed to the conveyor belt at an inclination angle ranging from 30° to 89°.

10. An apparatus for use with a plurality of empty packages with respective openings to package a plurality of fragile goods, comprising a movable conveyor belt having a length, a plurality of containers spaced along the length of the conveyor belt and secured to the conveyor belt, each of the plurality of containers adapted to receive one or more fragile goods, a baler including an elevator placed collinearly with each of the stacking towers secured to the conveyor belt with one or more fragile goods in the chamber configured to place an opening of one of the plurality of empty packages over the each of the plurality of containers with one or more fragile goods, the elevator transporting a shutter that seizes the empty package by its mouth, and the conveyor belt configured so that further advancement of the conveyor belt causes the each of the plurality of containers with one or more fragile goods to tilt so that the one or more fragile goods slide into the respective package and the respective package slides off the container, in each case under the force of gravity, whereby the elevator facilitates precise collinear placement of the empty package over the stacking tower with goods in the chamber.

11. The apparatus of claim 10, wherein the each of the plurality of containers has a chamber for receiving the one or more fragile goods.

12. The apparatus of claim 10, further comprising a drive gear coupled to the conveyor belt for advancing each of the plurality of containers with one or more fragile goods to the baler.

13. The apparatus of claim 10, further comprising a gear, wherein the conveyor belt is coupled to the gear and tilts as it extends at least partially around the gear.

14. The apparatus of claim 10, wherein the conveyor belt is an endless conveyor belt.

15. The apparatus of claim 10, wherein each of the plurality of containers is fixed to the conveyor belt at an inclination angle ranging from 30° to 89°.

* * * * *